US006427939B1

(12) United States Patent
Miyata et al.

(10) Patent No.: US 6,427,939 B1
(45) Date of Patent: Aug. 6, 2002

(54) COILING METHOD AND COILING APPARATUS FOR A METAL FOIL

(75) Inventors: Takeshi Miyata; Tsutomu Matsubara; Yasuhiro Yamaguchi; Akinobu Kamimaru, all of Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/424,547

(22) PCT Filed: Mar. 25, 1999

(86) PCT No.: PCT/JP99/01528

§ 371 (c)(1),
(2), (4) Date: Nov. 24, 1999

(87) PCT Pub. No.: WO99/50002

PCT Pub. Date: Oct. 7, 1999

(30) Foreign Application Priority Data

Mar. 26, 1998 (JP) ..... 10-079922

(51) Int. Cl.[7] ..... B65H 26/04; B65H 26/06; B65H 23/16

(52) U.S. Cl. ..... 242/534.2; 242/548; 242/615.1; 242/615.2

(58) Field of Search ..... 242/534, 534.2, 242/548, 615.2, 615.1

(56) References Cited

U.S. PATENT DOCUMENTS 4,463,586 A * 8/1984 Griffin ..... 242/534
4,674,310 A * 6/1987 Ginzburg ..... 72/11.4
5,275,345 A * 1/1994 Stahl et al. ..... 242/547
5,957,404 A * 9/1999 Frampton et al. ..... 242/547
6,095,452 A * 8/2000 Leskinen ..... 242/534

FOREIGN PATENT DOCUMENTS

| | | | | |
|---|---|---|---|---|
| EP | 1005922 A1 | * | 6/2000 | |
| JP | 55-10619 A | * | 8/1980 | ..... 72/250 X |
| JP | 5886933 | * | 5/1983 | |
| JP | 63-268502 | | 11/1988 | |
| JP | 1-245917 | | 10/1989 | |
| JP | 1-289509 | | 11/1989 | |
| JP | 7148505 | * | 6/1995 | |
| JP | 9-315633 | | 12/1997 | |

* cited by examiner

*Primary Examiner*—Michael R. Mansen
*Assistant Examiner*—Minh-Chau Pham
(74) *Attorney, Agent, or Firm*—Young & Thompson

(57) ABSTRACT

An anti-crimping roll is fixed to a vehicle moving in a direction perpendicular to the moving trace of a piston by way of a cylinder extending/shrinking the piston in a linear direction, and they are disposed at a position capable of moving along a longitudinal direction of a steel sheet within a plane in which the anti-crimping roll is perpendicular to the axis of rotation of a tension reel. A control device calculates an aimed winding angle of the steel sheet to the anti-crimping roll capable of avoiding occurrence of crimps based on a thickness and a width of the steel sheet, and drives the cylinder and the vehicle such that the calculated angle is aligned with an actual wind-up angle calculated from the stroke amount of the piston, moving amount of the vehicle to adjust the position of the anti-crimping roll. Since the position of the anti-crimping roll is automatically controlled depending, for example, on the change of the coil diameter during coiling, occurrence of crimps can be avoided easily without imposing burdens on an operator.

5 Claims, 7 Drawing Sheets

FIG. 4(a)

IN A CASE OF COILING
A METAL FOIL OF 960 mm WIDTH

| t thickness (mm) | Aimed wind-up angle $\theta$ * |
|---|---|
| 0.09 | more than 14 degree |
| 0.06 | more than 27 degree |
| 0.05 | more than 31 degree |
| 0.03 | more than 37 degree |

FIG. 4(b)

IN A CASE OF COILING
A METAL FOIL OF 0.05 mm THICKNESS

| L thickness (mm) | Aimed wind-up angle $\theta$ * |
|---|---|
| 800 | more than 18 degree |
| 1,000 | more than 32.5 degree |
| 1,200 | more than 36 degree |

COILING METHOD AND COILING APPARATUS FOR A METAL FOIL

TECHNICAL FIELD

The present invention relates to a coiling method and a coiling apparatus for a metal foil, for example, in a facility of manufacturing a rolled metal foil or the like while coiling in a coiled shape and, more in particular, it relates to a coiling method and a coiling apparatus for coiling a metal foil such as stainless steel or copper with a thickness of 0.3 (mm) or less.

BACKGROUND OF ART

In a facility of manufacturing a metal foil while coiling the same in a coiled shape (for example, rolling facility), since the metal foil is coiled under tension, string elongation occurs between a deflector roll and a tension reel (coiling reel). When the string elongation portion is coiled into a coiled shape, since it is coiled in a flexed state, for example, as shown in FIG. 8, it results in crimps.

If crimps occur in the course of coiling to the tension reel, it is necessary to once stop the facility because of requirement for removing them, which lowers the productivity and results in lowering of the yield by cutting off the crimped portion. Further, in view of the productivity, it is more advantageous to manufacture a smaller number of larger unit weight coils than to manufacture a greater number of smaller unit weight coils since the load of coil handling is decreased. However, removal of the crimped portions upon occurrence of crimps also gives rise to a problem of dividing the coils thereby producing a number of smaller unit weight coils. Heretofore, in order to avoid occurrence of such crimps, it has been proposed, for example, a method of disposing an anti-crimping roll at a position just in the vicinity of a tension reel thereby preventing occurrence of crimps as described, for example, in Japanese Unexamined Patent Publication No. 63-268502 or Japanese Unexamined Patent Publication No. 1-289509. Further, it has been proposed a method of disposing a anti-crimping roll moveably and winding-up a metal foil while pressing the roll at a predetermined pressing force to the foil.

By the way, the anti-crimping roll can provide more smoothing effect as it is pressed to a metal foil at a position nearer to a contact point between the metal foil coil already coiled and a metal foil to be coiled.

However, in the method of disposing the anti-crimping roll at a predetermined position as described in Japanese Unexamined Patent Publication No. 63-268502 and Japanese Unexamined Patent Publication No. 1-289509, since the diameter of the coil increases as the metal foil is coiled, only products of small coil unit weight can be manufactured. If the coil and the anti-crimping roll are spaced apart excessively, it results in a problem incapable of completely preventing occurrence of crimps in a case of coiling an extremely thin and broad width metal foil, for example, of about 30 ($\mu$m) of thickness and 1000 (mm) of width.

On the other hand, according to the method as described in Japanese Unexamined Patent Publication No. 1-245917, since the anti-crimping roll can always be controlled to an optimal position, the method is free from the problem as in the Japanese Unexamined Patent Publication No. 63-268502 and Japanese Unexamined Patent Publication No. 1-289509, but this involves a problem that determination for the pressing force of the anti-crimping roll is troublesome. That is, it involves a problem of requiring to determine an appropriate pressing force on every change of conditions such as thickness and width by conducting passage of sheets for several times, which worsens the efficiency.

In view of the above, the present invention has been accomplished taking notice on the problems not yet solved in the prior art and it is an object thereof to provide a coiling method and a coiling apparatus for a metal foil capable of easily avoiding occurrence of crimps upon coiling a metal foil in a coiled shape.

DISCLOSURE OF THE INVENTION

For attaining the foregoing object, the present invention provides a coiling method for a metal foil for coiling a metal foil guided by a deflector roll to a coiling reel while pressing the same by an anti-crimping roll, wherein the position of the anti-crimping roll is controlled such that the wind-up angle of the metal foil to the anti-crimping roll is greater than an aimed wind-up angle capable of preventing occurrence of crimps.

That is, since the position of the anti-crimping roll is controlled such that the wind-up angle of the metal foil to the anti-crimping roll disposed between the deflector roll and the coiling reel is a wind-up angle capable of preventing occurrence of crimps calculated based on the thickness, the width and the like, occurrence of crimps can be avoided easily.

It is preferred to control the position of the anti-crimping roll such that the wind-up angle is greater than the aimed wind-up angle and less than the aimed wind-up angle plus 20 degree. This is for preventing occurrence of undesired warps to the metal foil in view of quality.

The position of the anti-crimping roll may be controlled by automatically conducting processings of calculating the aimed wind-up angle based on the thickness and the width of the metal foil, calculating the aimed position of the anti-crimping roll at which the actual wind-up angle is greater than the aimed wind-up angle, calculating the moving amount of the anti-crimping roll from a current position to the aimed position and moving the anti-crimping roll in accordance with the moving amount. Occurrence of crimps can be prevented automatically with such procedures. Further, the aimed wind-up angle may be calculated so as to satisfy: $\sigma x - \sigma m < \sigma c$. In the equation, $\sigma x$ is a shearing stress exerted by a rolling tension of the metal foil to a pressed portion of the metal foil pressed by the anti-crimping roll, $\sigma m$ is a frictional force between the metal foil and the anti-crimping roll and $\sigma c$ is a buckling stress caused by a shearing stress in a plate or a cylindrical shell.

Further, the actual wind-up angle may be calculated based on a coordinate of the position for the center of rotation of the deflector roll, a coordinate of the position for the center of rotation of the anti-crimping roll and an outer diameter of the metal foil on the coiling reel.

Further, another object of the present invention is to provide a coiling apparatus for a metal foil having a anti-crimping roll for pressing the metal foil disposed between a coiling reel for coiling the metal foil and a deflector roll, wherein the apparatus comprises moving means for moving the anti-crimping roll to a predetermined position, and position control means for driving the moving means such that a wind-up angle of the metal foil to the anti-crimping roll is greater than an aimed wind-up angle capable of preventing the occurrence of crimps, and controlling a position of the anti-crimping roll.

That is, the anti-crimping roll for pressing the metal foil during passage is disposed between a coiling reel for coiling the metal foil and a deflector roll, and the anti-crimping roll is disposed movably by the moving means.

Then, the moving means is controlled by the position control means such that the actual wind-up angle of the metal foil to the anti-crimping roll is greater than the aimed wind-up angle of the metal foil to the anti-crimping roll capable of preventing occurrence of crimps that is calculated, for example, based on the thickness or the width of the metal foil, thereby controlling the position of the anti-crimping roll.

Accordingly, when an aimed wind-up angle is set in accordance with a metal foil to be wound-up, the anti-crimping roll is automatically moved to a position capable of preventing occurrence of crimps in accordance with various factors of the metal foil thereby capable of easily avoiding occurrence of crimps.

In this case, if the anti-crimping roll is moved by the moving means within a plane perpendicular to the axis of rotation of the anti-crimping roll, an actual wind-up angle of the metal foil to the anti-crimping roll can be changed easily.

Further, if the moving means comprises first moving means capable of moving within the plane in a direction of pressing the anti-crimping roll to the metal foil and second moving means capable of moving within the plane in a direction intersecting the moving trace of the anti-crimping roll moved by the first moving means, the anti-crimping roll can be moved easily within a plane perpendicular to the axis of rotation of the anti-crimping roll.

BRIEF DESCRIPTION OF THE DRAWINGS

FIGS. 4(*a*) and 4(*b*) show examples of an aimed wind-up angle θ*.

BEST MODE FOR PRACTICING THE INVENTION

A preferred embodiment of the present invention is to be explained.

Figure 1:
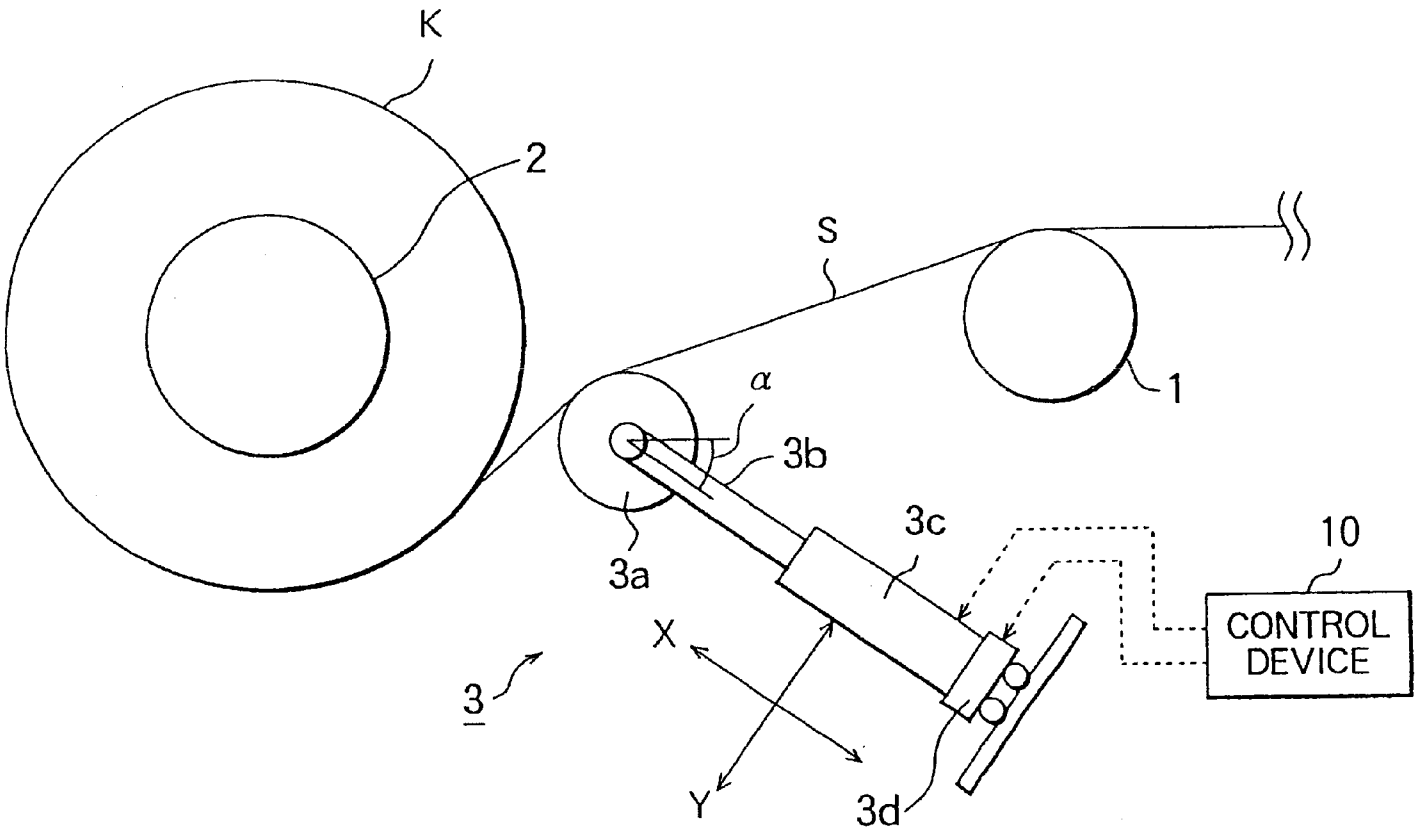
FIG. 1 is a schematic constitutional view showing an example of a coiling apparatus for a metal foil according to the present invention.

FIG. 1 is a schematic constitutional view showing an example of a coiling apparatus for a metal foil according to the present invention, which is applied to a 20 stage reciprocating Sendzimir mill.

In the figure, S denotes a steel sheet as a metal foil which is, for example, a ferrite series stainless steel with 50 (μm) thickness, 1000 (mm) width and 12000 (m) coil length. The steel sheet S proceeds to the left in FIG. 1 under rolling, guided by a deflector roll 1 and coiled to a tension reel 2 into a coil K.

An anti-crimping device 3 for pressing the steel sheet S and movable along the longitudinal direction of the steel sheet S is disposed between the deflector roll 1 and the tension reel 2. The anti-crimping device 3 comprises an anti-crimping roll 3*a* for pressing the steel sheet S, a piston 3*b* connected with a support frame for rotatably supporting the same a cylinder 3*c* for extendably/shirinkably supporting a piston 3*b* connected with a support frame for rotatably supporting the same in a plane perpendicular to the tension reel 2 along the direction of a linear line (direction of axis X), and a vehicle 3*d* to which the cylinder 3*c* is secured and which can move within a plane perpendicular to the axis of rotation of the tension reel 2 in a direction perpendicular to a moving trace of the piston 3*b* (direction of axis Y). The vehicle 3*d* is adapted to move along the longitudinal direction of the steel sheet S. Assuming an angle formed between the moving trace of the piston 3*b* and a horizontal plane as α, the anti-crimping roll 3*a* can move freely within a plane containing an axis X having an angle α relative to the horizontal plane and an axis Y in perpendicular thereto and a plane in perpendicular to the tension reel 2 by controlling the stroking length of the piston 3*b* and the position for the vehicle 3*d*.

The angle α formed between the moving trace of the piston 3*b* and the horizontal plane is optional and it is preferably near an angle at which the anti-crimping roll 3*a* presses the steel sheet S vertically.

The cylinder 3*c* and the vehicle 3*d* are put to driving control by the control device 10.

In this embodiment, the cylinder 3*c* and the vehicle 3*d* correspond to the moving means, the cylinder 3*c* corresponds to the first moving means, the vehicle 3*d* correspond to the second moving means and the control device 10 corresponds to the position control means.

The control device 10 calculates an aimed wind-up angle θ* as an aimed value of the wind-up angle of the steel sheet S to the anti-crimping roll 3*a*, for example, based on a thickness and a width of the steel sheet S to be passed which are inputted by an operator, and conducts positional control of the anti-crimping roll 3*a* by driving control of the cylinder 3*c* and the vehicle 3*d* such that the actual wind-up angle Θ is greater than the aimed wind-up angle θ*. Preferably, the control device 10 controls the position of the roll 3*a* such that the actual wind-up angle Θ and the aimed wind-up angle θ* are in a relation: $\theta^* \leqq \Theta \leqq \theta^* + 20$ (degree).

This is because warps not suitable in view of quality would occur in the metal foil if Θ exceeds θ*+20 degree.

Figure 2:
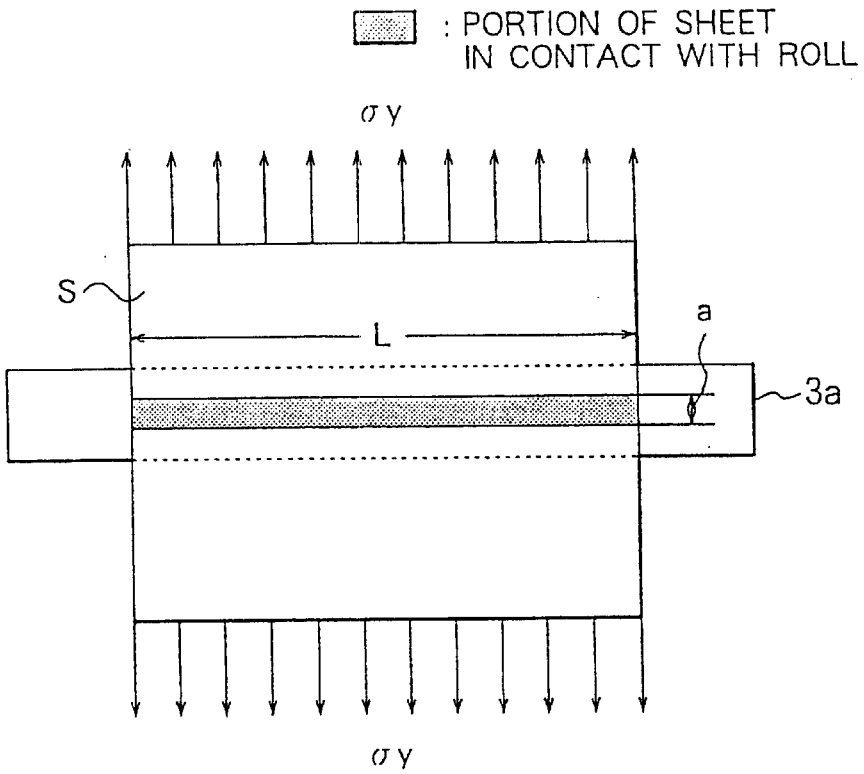
FIGS. 2(*a*) and 2(*b*) are explanatory views for explaining a calculation method for an aimed wind-up angle θ*.
Figure 2B:
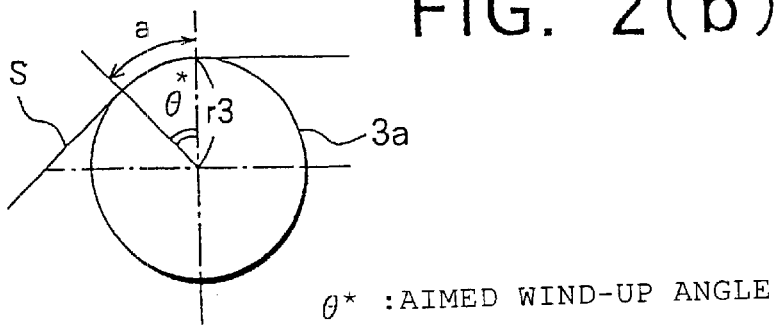
Figure 3A:
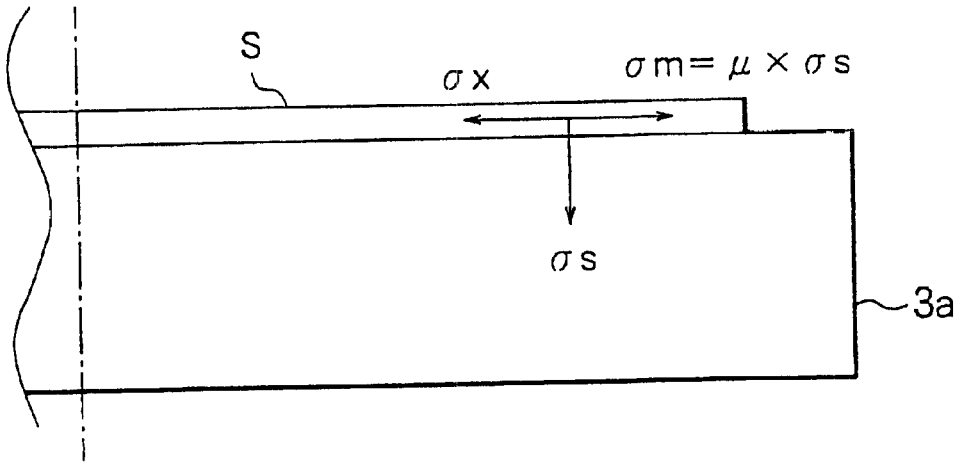
FIGS. 3(*a*) and 3(*b*) are explanatory views for explaining a calculation method for an aimed wind-up angle θ*.
Figure 3B:
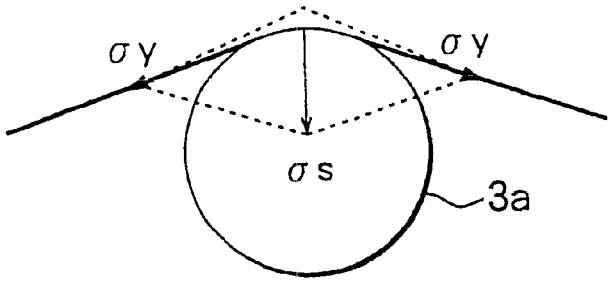

FIGS. 2(*a*) and 2(*b*) and FIGS. 3(*a*) and 3(*b*) are explanatory views for explaining a calculation method for the aimed wind-up angle θ* and show the state in which the steel sheet S is in contact with the anti-crimping roll 3*a*.

Assuming the width of the steel sheet S as L(mm), the length of the steel sheet S in contact with the anti-crimping roll 3*a* (roll contact length) as a (mm), a is represented by the following equation (1). θ is a wind-up angle (degree), $r_3$ is a radius (mm) of a portion of the steel sheet S in contact with the anti-crimping roll 3*a* (=radius of the anti-crimping roll 3*a*).

$$a = 2\pi r_3 \cdot \theta / 360 \tag{1}$$

Buckling stress σc(kgf/mm$^2$) by shearing stress is represented by the following equation (2)

$$\sigma c = Ks \cdot \sigma e \tag{2}$$

$$Ks = 5.34 + 4 \times (a/L)^2$$

in which $$\sigma e = K \cdot (\pi^2 E) / \{12(1-\nu^2) \cdot a^2\} \cdot t^2$$

(equation for the buckling of a plate)

$$\sigma e=K\cdot E\cdot(t/r_3)\cdot\{3(1-\nu^2)\}^{1/2}\times(\theta/360)$$

(equation for the buckling of a cylindrical shell)

$$K=f(Z)=\alpha\times Z+\beta$$

$$Z=(1-\nu^2)^{1/2}\cdot L^2/(r_3 t)$$

In the above described equations, Ks is a shearing buckling coefficient, σe is a buckling limit stress (kgf/mm$^2$), K is an axial compression buckling coefficient, E is a Young's modulus of the steel sheet S (kgf/mm$^2$), ν is a Poisson's ratio of the steel sheet S, L is a width (mm) of the steel sheet S, t is a thickness (mm) of the steel sheet S, and Z is a shape coefficient and the shape is of a cylindrical shell for a portion of the steel sheet S in contact with the anti-crimping roll 3*a*. Further, α and β are constants. The constants α and β are different depending on the material and can be determined by an experiment for several times.

The equation for the buckling of the plate may be used for σe but the equation for the buckling of the cylindrical shell may be used for the improvement of accuracy to a portion of the steel sheet S pressed by the anti-crimping roll 3*a* since it forms, exactly, a portion of a cylinder.

The shearing stress σx (kgf) exerted by the rolling tension σy (kgf) is represented by the following equation (3). In the equation, γ is a value for determining the maximum shearing force and γ=0.5.

$$\sigma x=\gamma\times\sigma y \tag{3}$$

The force σs (kgf) of the steel sheet S pressing the anti-crimping roll 3*a* is represented by the following equation (4):

$$\sigma s=2\cdot\cos\{(180-\theta)/2\}\sigma y \tag{4}$$

The frictional force Cm is represented by the following equation (5). In the equation, $\mu$ is a friction coefficient.

$$\sigma m=\mu\cdot\sigma s \tag{5}$$

Accordingly, no crimps occur if the steel sheet S is wound-up so as to satisfy the following relation (6):

$$\sigma x-\sigma m<\sigma c \tag{6}$$

FIGS. 4(*a*) and 4(*b*) show examples of calculating an aimed wind-up angle θ* of the steel sheet S to the anti-crimping roll 3*a* to satisfy the relation (6). FIG. 4(*a*) represents a relation between the thickness t (mm) and an aimed wind-up angle θ* (degree) upon coiling a metal foil with 960 (mm) width. FIG. 4(*b*) represents a relation between the width L (mm) and the aimed wind-up angle θ* (degree) upon coiling a metal foil with 0.05 (mm) thickness.

Accordingly, upon coiling a steel sheet S, for example, with 960 (mm) width and 0.06 (mm) thickness, since it may suffice that the aimed wind-up angle δ is 27 (degree) or more in view of FIG. 4(*a*), the aimed wind-up angle θ* may be set, for example, as θ=32 (degree). Since some deviation may be expected depending on the level for the position control accuracy, the control frequency or the like of the anti-crimping roll as described previously, the value is set by +5 (degree) in view of safety. Further, a large difference may be taken so long as the performance of the facility such as pressing force of the cylinder allows.

Figure 5:
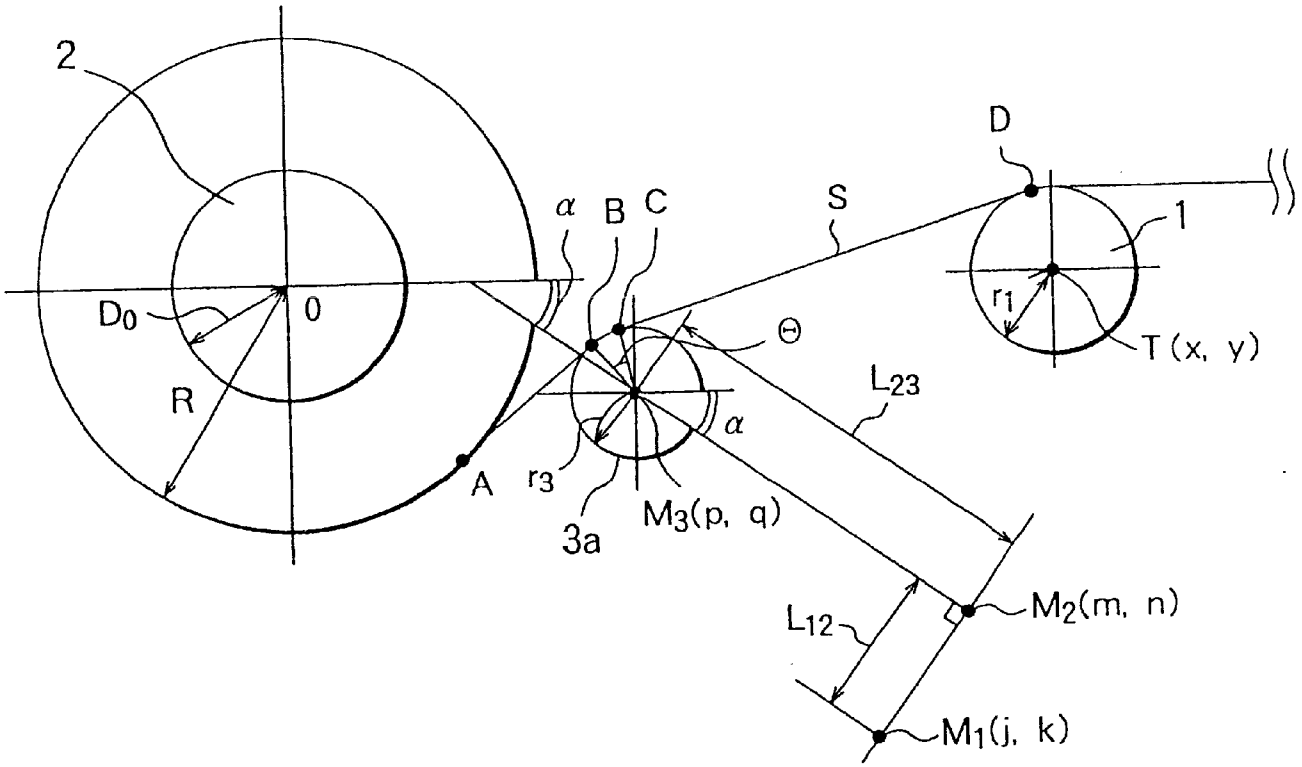
FIG. 5 is an explanatory view for explaining a calculation method for an actual wind-up angle Θ.

FIG. 5 is an explanatory view for explaining a detection method of an actual wind-up angle Θ of a steel sheet S to an anti-crimping roll 3*a*. In the figure, point A represents a contact point between a steel sheet S already coiled on a tension reel 2 and a steel sheet S to be coiled, and B-D represent contact points between the steel sheet S and the anti-crimping roll 3*a* or the deflector roll 1. Further, $M_1$ (j, k) represents a reference position such as an initial position of a vehicle 3*d*, $M_2$ (m, n) represents a position of the vehicle 3*d* and $M_3$(p, q) represents a position of the center of rotation of the anti-crimping roll 3*a*. Further, O represents a center of rotation of the tension reel 2 and T represents a center of rotation of the deflector roll 1. The points O, $M_1$ and T are fixed points, while $M_2$, $M_3$ are points that change in accordance with the movement of the cylinder 3*c* and the vehicle 3*d*. Further, points A–D are points that change optionally in accordance with the positional change of the coil radius R formed by coiling and the center of rotation $M_3$ of the anti-crimping roll 3*a*.

The center of rotation $M_3$ of the anti-crimping roll 3*a* moves linearly in the direction of an angle a relative to the horizontal direction by the extension/shrinking of the piston 3*b* and moves along the steel sheet S in accordance with the movement of the vehicle 3*d*. Accordingly, the point $M_2$ moves in a direction perpendicular to the trace of the point $M_3$. Further, assuming the distance between the point $M_2$ and the point $M_1$, namely, the moving amount of the vehicle 3*d* as $L_{12}$ and the distance between the points $M_2$ and $M_3$, namely, the stroke amount of the piston 3*b* as $L_{23}$, an actual wind-up angle Θ of the steel plate S to the anti-crimping roll 3*a* (<$BM_3C$ in the figure) is calculated by the following equation (7):

$$\tan\Theta=F-F' \tag{7}$$

in which F represents the gradient of A–B, and F' represents the gradient of C–D which are represented respectively by the following equations (8) and (9).

$$F=\tan\{\sin^{-1}((R+r_3)/(p^2+q^2)^{1/2})+\tan^{-1}(q/p)\}$$

in which $$\tan^{-1}(q/p)<0 \tag{8}$$

$$F'=\tan(\sin^{-1}W+\tan^{-1}Z) \tag{9}$$

in which $$W=(r_1-r_3)/\{(x-p)^2+(y-q^2)\}^{1/2}$$

$$Z=(y-q)/(x-p)$$

in which R represents a coil radius of the tension reel 2, $r_3$ represents a radius of the anti-crimping roll 3*a* and $r_1$ represents a radius of the deflector roll 1.

The coil radius R of the tension reel 2, the coordinate (p, q) for the point $M_3$ and the coordinate (m, n) for the point $M_2$ are represented respectively by the following equations (10), (11) and (12).

$$R=t\cdot N=\{(\pi\cdot D_0)^2-2\cdot t\cdot L_L\}^{1/2}-\pi D_0 \tag{10}$$

$$(P,\ q)=(m-L_{23}\times\cos\alpha,\ n+L_{23}\times\sin\alpha) \tag{11}$$

$$(m,\ n)=(j-L_2\times\sin\alpha,\ k+L_{12}\times\cos\alpha) \tag{12}$$

In the equations, N represents the number of coiled turns, $D_0$ represents a sleeve outer diameter of the tension reel 2, $L_L$ represents a coiling length, that is, a length of the steel sheet S coiling to the tension reel 2 (rolling length) and the coiling length $L_L$ is calculated, for example, by the rolling speed and the rolling time.

Accordingly, the gradient F for A–B and the gradient F' for C–D can be calculated by substituting the equations (10) to (12) into the equations (8) and (9), and actual windup angle Θ can be calculated by calculating tan Θ from the gradients F, F' and the equation (7).

Figure 6:
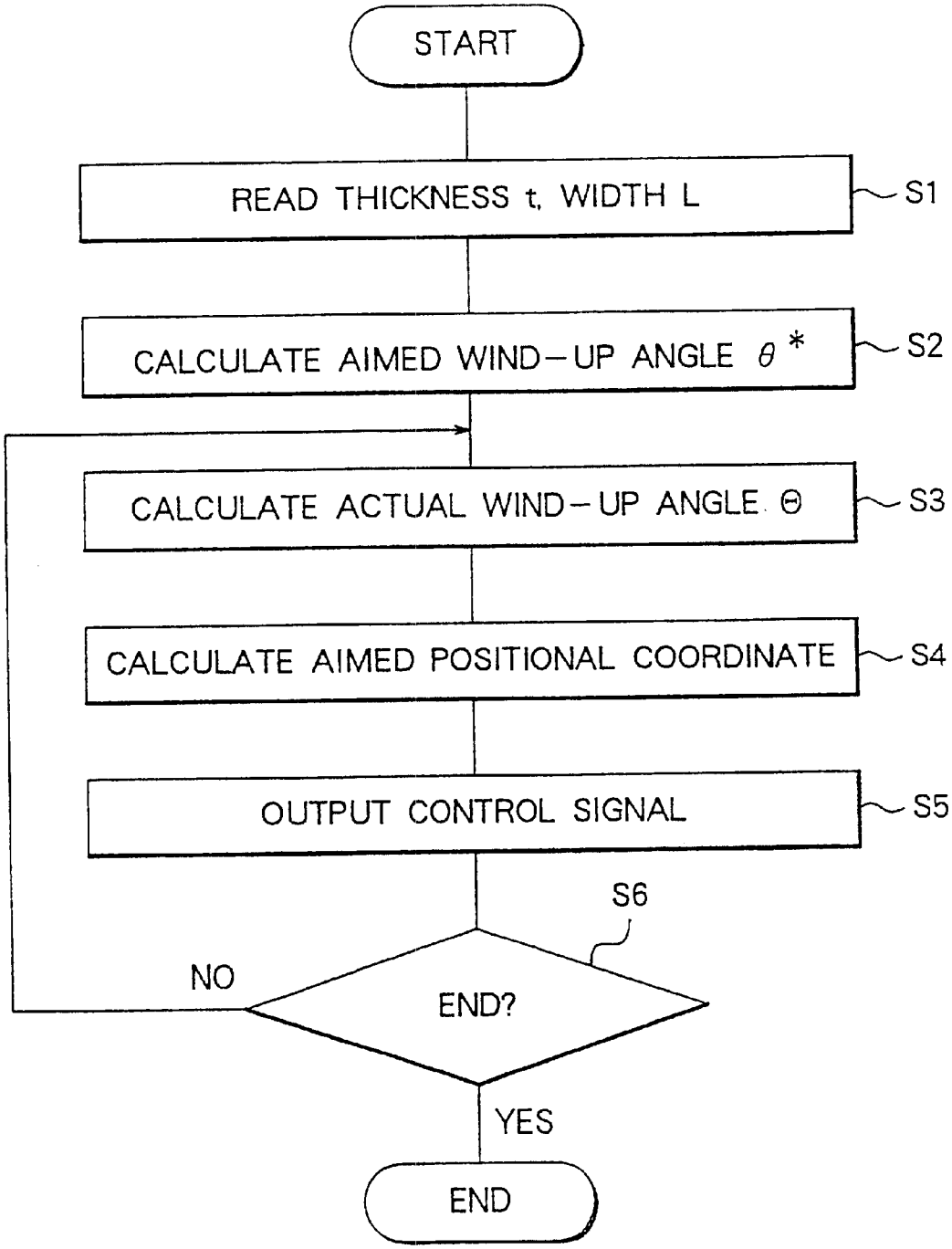
FIG. 6 is a flow chart showing an example of processing procedures in a control device.

FIG. 6 shows an example of processing procedures in the control device 10.

When a thickness t and a width L of a steel sheet S to be passed are inputted by an operator (step S1), the control device 10 calculates an aimed wind-up angle θ* based thereon as described above (step S2).

Then, an actual wind-up angle Θ is calculated, for example, based on the stroke amount of the piston 3*b* and the current position of the vehicle 3*d* detected from a not illustrated sensor for detecting the stroke amount of the piston 3*b* and from a not illustrated sensor for detecting the moving amount of the vehicle 3*d*, or on the stroke amount of the piston 3*b* and the current position of the vehicle 3*d* calculated from the control amount in the past for the cylinder 3*c* and the vehicle 3*d*, the positional coordinate of the center of rotation of the anti-crimping roll 3*a* detected from them and the equations (7)–(12) described above in the manner as described previously (step S3).

Then, a positional coordinate of the anti-crimping roll 3*a* at which the aimed wind-up angle θ* calculated in the step S2 and the actual wind-up angle Θ calculated in the step S3 can be aligned is calculated (step S4). This is calculated by calculating the aimed stroke amount of the piston 3*b*, for example, from the current position of the vehicle 3*d* and the aimed wind-up angle θ* based on the equations (7)–(12) and by calculating from the thus calculated stroke amount. If the result is not obtained, the position of the vehicle 3*d* is displaced being regarded as a provisional position and calculation is conducted again.

Then, the stroke amount of the piston 3*b* and the moving amount of the vehicle 3*d* for moving the anti-crimping roll 3*a* to the calculated position are calculated, and a control signal corresponding thereto is generated and outputted (step S5). This changes the stroke amount of the piston 3*b* and the position of the vehicle 3*d*, to change the position of the anti-crimping roll 3*a* and change the wind-up angle of the steel sheet S to the anti-crimping roll 3*a*, which is controlled so as to be aligned with the aimed wind-up angle θ*.

Then, processings for steps S3–S6 are repeated till the coiling of the steel sheet S is entirely completed (step S6).

Then, the operation of the embodiment is to be explained.

When the steel sheet S is coiled, an operator at first operates the control device 10 and inputs a thickness t and a width L of the steel sheet S to be coiled.

The control device 10 calculates an aimed wind-up angle θ* based on the inputted thickness t and the width L and, when coiling is started, calculates the current wind-up angle Θ). Then, the stroke amount of the piston 3*b* and the position of the vehicle 3*d* are controlled such that the current wind-up angle Θ is aligned with the aimed wind-up angle θ, to control the position of the anti-crimping roll 3*a*.

Accordingly, the control is applied during coiling such that the aimed wind-up angle θ* and the current wind-up angleΘ are aligned with each other and, since the aimed wind-up angle θ* is a value set as an angle capable of avoiding the occurrence of crimps in the steel sheet S, occurrence of crimps can be avoided reliably. Further, since the position of the anti-crimping roll 3*a* is sequentially adjusted during coiling, occurrence of crimps can be avoided easily without operator's burden even if the coil diameter is increased.

Further, since the position of the anti-crimping roll 3*a* can be adjusted automatically, the operator can easily avoid the occurrence of crimps by merely inputting the thickness t and the width L of the steel sheet S irrespective that the unit weight of coils is small or large. Further, since the position control for the anti-crimping roll 3*a* is automatically conducted in accordance with the thickness t and the width L, it can easily cope also with the change of the thickness t and the width L.

Accordingly, since occurrence of crimps in the steel sheet S can be avoided, lowering of the productivity can be prevented and lowering of the yield can be avoided.

In the above described embodiment, while explanations have been made to a case of controlling the position of the anti-crimping roll 3*a* such that the current wind-up angle Θ is aligned with the aimed wind-up angle θ*, a length for a free portion in the longitudinal direction of the steel sheet S not in contact with the roll 3*a* capable of attaining the aimed wind-up angle θ* may be calculated, for instance, and the anti-crimping roll 3*a* may be moved to a portion capable of attaining the same.

Further, in the foregoing embodiment, while the anti-crimping roll 3 is automatically moved so as to align the aimed wind-up angle θ* with the actual wind-up angle Θ, the anti-crimping roll 3*a* may also be moved manually.

Further, in the foregoing embodiment, explanations have been made to a case of applying the cylinder 3*c* and the vehicle 3*d* as the moving means and moving the position of the anti-crimping roll 3*a* by them, but it is not restricted only thereto and a ball screw may be combined, for example, so as to move the anti-crimping roll 3*a* or, alternatively, a cylinder may be combined or a vehicle may be combined to move the anti-crimping roll 3*a*. In summary, any moving means is applicable so long as it can freely move the anti-crimping roll 3*a* within a plane including the axis X and the axis Y.

Further, in the above described embodiment, explanations have been made to a case of calculating the coil radius R based on the coiled length $L_L$, calculated, for example, by the rolling speed and the rolling time, but it is not restrictive only thereto and, for example, a sensor for detecting the coil radius R may be provided. Further, since the coil radius R is determined uniquely based on the rolling speed and the rolling time, change of the coil radius R relative to the rolling time may be stored as a map, for example, being corresponded on every rolling speed and the coil radius R may be detected based on the map.

Further, since it can be regarded that the correspondence between the coil radius R, and the stroke amount of the piston 3*b* and the position of the vehicle 3*d* is determined uniquely, the coil radius R may be corresponded to the stroke amount of the piston 3*b* and the position of the vehicle 3*d* and stored as a map also in this case and the stroke amount of the piston 3*b* and the position of the vehicle 3*d* may be detected based on the map.

Further, since the coil radius R is determined uniquely in accordance with the rolling time, the rolling time may be corresponded to the stroke amount of the piston 3*b* and the position of the vehicle 3*d* and stored as a map and the position of the anti-crimping roll 3*a* may be controlled by controlling the stroke amount of the piston 3*b* and the position of the vehicle 3*d* in accordance with the rolling time.

Further, in the above described embodiment, explanations have been made to a case of applying the coiling apparatus for the metal foil according to the present invention to a rolling line, it is not restricted only to the rolling facility but it is also applicable to a facility of coiling a metal foil in a coiled shape such as an annealing facility and a pickling facility.

Further, in the above described embodiment, while explanations have been made to a case of disposing a single anti-crimping roll 3*a* between the reflector roll 1 and the tension reel 2, a plurality of anti-crimping rolls may be disposed, in which an aimed wind-up angle θ* is set for each of the anti-crimping rolls in the same manner as above and the position of the anti-crimping rolls may be controlled such that this setting angle may be aligned with the actual wind-up angle Θ.

Then, the above described embodiment will be explained specifically referring to an example.

In this example, a coiling apparatus for a metal foil according to the present invention is applied to a 20 stage reciprocating Sendzimir rolling machine and a ferritic stainless steel sheet of 50 (μm) thickness, 960 (mm) width and 12000 (m) coil length was coiling while rolling under the conditions at a rolling tension of 20 (kg/mm$^2$).

The aimed wind-up angle θ* under the condition is set as 31 degree or more in view of FIG. 4(*a*).

Further, a sleeve of 660 (mm) outer diameter was inserted into the tension reel 2 and an anti-crimping roll 3*a* of 75 (mm) radius and 1300 (mm) roll length was used.

Figure 7:
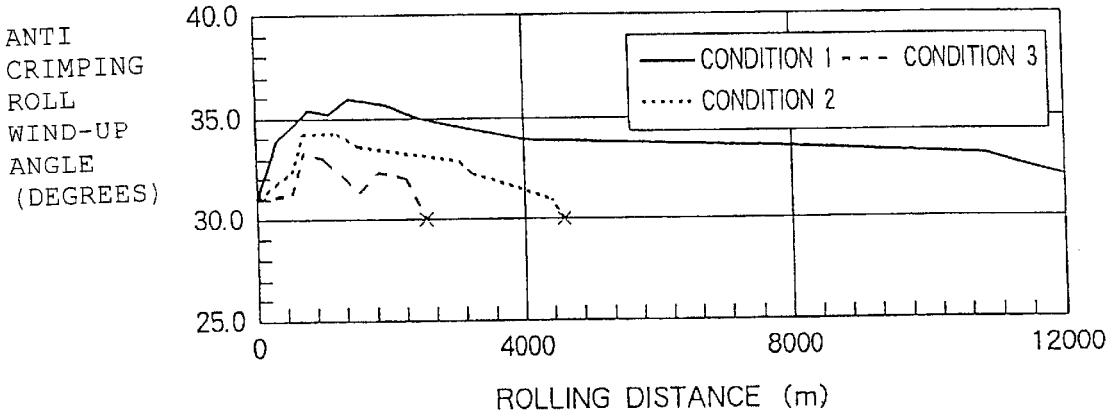
FIG. 7 is a graph of a result of experiment showing a rolling distance till crimps occur when winding is taken place while varying a setting condition for a wind-up angle Θ.
Figure 8:
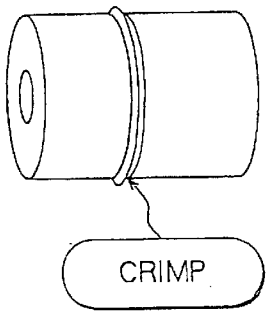
FIG. 8 is an explanatory view for explaining occurrence of crimps.

FIG. 7 shows a relation between a wind-up angle θ of an anti-crimping roll and a rolling length till crimps occur when rolling is conducted while changing the position of the anti-crimping roll 3*a*. It has been confirmed that crimps occur at the instance the wind-up angle θ approaches 30 (degree) in a case of varying the wind-up angle θ between about 30 to 35 (degree) as shown in conditions 2 and 3, whereas up to 12000 (m) length can be coiled with no occurrence of crimps in a case of coiled while keeping the wind-up angle of the anti-crimping roll 3*a* at 32 to 38 (degree) as shown in the condition 1 and it can be confirmed that even a coil of a large unit weight can be manufactured stably.

INDUSTRIAL APPLICABILITY

As has been described above, according to the coiling method and the coiling apparatus for a metal foil of the present invention, since the position of the anti-crimping roll is controlled such that the actual wind-up angle of the metal foil to the anti-crimping roll capable of preventing occurrence of crimps is greater than the aimed wind-up angle, occurrence of crimps can be avoided easily by merely setting the aimed wind-up angle depending on the metal foil to be coiled, irrespective of the change of the coil diameter or the change of the thickness and the width of the metal foil.

What is claimed is:

1. An apparatus for coiling a metal foil having a thickness of 0.3 mm or less, the apparatus comprising:

a coiling reel for coiling the metal foil;

a deflector roll;

an anti-crimping roll for pressing the metal foil disposed between the coiling reel and the deflector roll;

moving means for moving the anti-crimping roll to a predetermined position; and position control means for driving the moving means such that a wind-up angle of the metal foil to the anti-crimping roll is greater than an aimed wind-up angle capable of preventing the occurrence of crimps, and controlling a position of the anti-crimping roll, wherein the moving means is adapted to move the anti-crimping roll within a plane perpendicular to an axis of rotation of the anti-crimping roll, wherein the moving means comprises first moving means capable of moving within the plane in a direction of pressing the anti-crimping roll to the metal foil and second moving means capable of moving within the plane in a direction intersecting the moving trace of the anti-crimping roll moved by the first moving means.

2. A method of coiling a metal foil with a thickness of 0.3 mm or less, comprising the steps of:

guiding the metal foil by a deflector roll to a coiling reel while pressing the metal foil by an anti-crimping roll; and controlling the position of the anti-crimping roll such that a wind-up angle of the metal foil to the anti-crimping roll is greater than an aimed wind-up angle capable of preventing occurrence of crimps, wherein the position of the anti-crimping roll is controlled by moving the anti-crimping roll within a plane perpendicular to an axis of rotation of the anti-crimping roll in a direction of pressing the anti-crimping roll to the metal foil and a direction intersecting the moving trace of the anti-crimping roll.

3. A method of coiling a metal foil with a thickness of 0.3 mm or less, comprising the steps of:

guiding the metal foil by a deflector roll to a coiling reel while pressing the metal foil by an anti-crimping roll; and controlling the position of the anti-crimping roll such that an actual wind-up angle of the metal foil to the anti-crimping roll is greater than an aimed wind-up angle capable of preventing occurrence of crimps, which is calculated as to satisfy the following equation:

$$\sigma x-\sigma m<\sigma c$$

in which σx is a shearing stress exerted by a rolling tension σy of the metal foil to a pressed portion of the metal foil pressed by the anti-crimping roll, σm is a frictional stress between the metal foil and the anti-crimping roll and σc is a buckling stress caused by a shearing stress in a plate or a cylindrical shell; and σx, σm and σc are represented by the following equations, respectively:

$$\sigma x=\gamma\times\sigma y$$

$$\sigma m=\mu\times 2\times\cos\{(180-\theta)/2)\}\times\sigma y$$

$$\sigma c=Ks\times\sigma e$$

in which γ is a value of 0.5, μ is a friction coefficient between the metal foil and the anti-crimping roll, θ is the aimed wind-up angle of the metal foil on the anti-crimping roll, Ks is a shearing buckling coefficient and σe is a buckling limit stress.

4. The method of coiling a metal foil as defined in claim 3, wherein the actual wind-up angle is calculated based on a coordinate of the position for a center of rotation of the deflector roll, a coordinate of the position for a center of rotation of the anti-crimping roll and the outer diameter of the metal foil on the coiling reel.

5. The method of coiling a metal foil as defined in claim 3, wherein the position of the anti-crimping roll is controlled by moving the anti-crimping roll within a plane perpendicular to an axis of rotation of the anti-crimping roll in a direction of pressing the anti-crimping roll to the metal foil and a direction intersecting the moving trace of the anti-crimping roll.

* * * * *